United States Patent [19]

Horsewell et al.

[11] 4,213,470

[45] Jul. 22, 1980

[54] TOBACCO-SMOKE FILTERS

[75] Inventors: Henry G. Horsewell, Totton; John D. Green; John A. Luke, both of Romsey; Raymond J. Harrison, North Baddesley, all of England

[73] Assignee: British-American Tobacco Company Limited, London, England

[21] Appl. No.: 850,071

[22] Filed: Nov. 10, 1977

[30] Foreign Application Priority Data

Nov. 19, 1976 [GB] United Kingdom ..... 48404/76

[51] Int. Cl.[2] ..... A24B 15/02

[52] U.S. Cl. ..... 131/261 B; 131/10.7

[58] Field of Search ..... 131/9, 10 R, 10 A, 10.3, 131/10.5, 10.7, 10.8, 200–203, 216, 261 R, 261 B, 264–266, 268

[56] References Cited

U.S. PATENT DOCUMENTS

| | | | |
|---|---|---|---|
| 2,819,720 | 1/1958 | Burbig | 131/10.7 |
| 2,954,773 | 10/1960 | Lebert | 131/10.5 |
| 3,752,165 | 8/1973 | Harllee et al. | 131/261 B |
| 3,768,489 | 10/1973 | Kiefer et al. | 131/261 B |
| 3,811,451 | 5/1974 | Berger | 131/10 R |
| 3,964,493 | 6/1976 | Baker | 131/10.5 |
| 4,033,362 | 7/1977 | Almquist et al. | 131/264 |

FOREIGN PATENT DOCUMENTS

| | | | |
|---|---|---|---|
| 1214319 | 12/1970 | United Kingdom | 131/10 R |

*Primary Examiner*—Robert W. Michell
*Assistant Examiner*—C. F. Rosenbaum
*Attorney, Agent, or Firm*—Kane, Dalsimer, Kane, Sullivan and Kurucz

[57] ABSTRACT

A tobacco-smoke filter has a filter body comprising at least one intermediate section which is located between end sections, has a cross section less than that of the end sections and lies wholly within the outline of the latter sections as viewed axially of the body, and a porous wrap of sheet material which is pervious to volatile constituents of tobacco smoke and which bounds, with the said body, at least one space affording a path through which smoke can pass when the filter is in use and from which said constituents are removed fom the smoke by diffusion through the said sheet material, each of the said sections being made of filter material. Suitably the body is of generally cylindrical form and composed of cellulose acetate. Advantageously the intermediate section is integral with at least one end section.

7 Claims, 12 Drawing Figures

TOBACCO-SMOKE FILTERS

This invention concerns tobacco-smoke filters and has special relevance to filters for cigarettes.

According to the invention, a tobacco-smoke filter comprises a filter body having at least one intermediate section which is located between end sections, has a cross section less than that of the end sections and lies wholly within the outline of the latter sections as viewed axially of the body, and a porous wrap of sheet material which is pervious to volatile constituents of tobacco smoke and which bounds with the said body, at least one space affording a path through which smoke can pass when the filter is in use and from which said constituents can be removed from the smoke by diffusion through the said sheet material, each of the said sections being made of filter material. Volatile constituents which can be thus removed include carbon monoxide and nitric oxide. Advantageously external surfaces of the body bounding the aforesaid space or spaces are substantially impervious to particulate-phase constituents of tobacco smoke.

Advantageously, the wrap completely encircles the body and bounds the said space or spaces around substantially the whole periphery of the said wrap. Preferably, the body is of generally cylindrical form and composed of fibrous material, for example cellulose acetate. It may, however, be composed of granular material, for example bonded granular carbon, or of foamed material, or a combination of the aforesaid materials, or it may take the form of a bundle of fine-bore tubes, for example hollow cellulose-acetate fibres.

In such a filter, the whole length of the body is available for filtration of the tobacco smoke. Nevertheless the filter presents no serious problems with respect to manufacture and attachment to cigarette tobacco rods. A normal profile can be maintained and normal production processes can be employed.

Advantageously the intermediate section of the body may be integral with one or other or both of the end sections.

If the body is made of cellulose acetate, the above-mentioned external surface or surfaces may be rendered impervious or substantially impervious by the application of heat to the cellulose acetate.

Reference will now be made, by way of example, to the accompanying diagrammatic drawings, in which.

Figure 1:
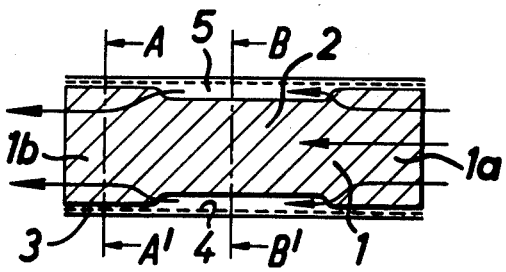
FIG. 1 shows a cigarette filter in axial section.
Figure 2:
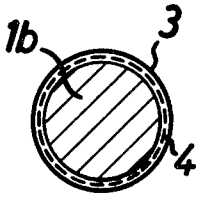
FIG. 2 is a cross section on the line A—A' in FIG. 1.
Figure 3:
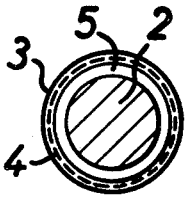
FIG. 3 is a cross section on the line B—B' in FIG. 1.
Figure 5:
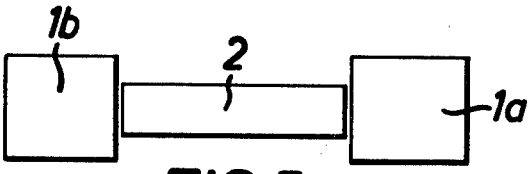
Figure 6:
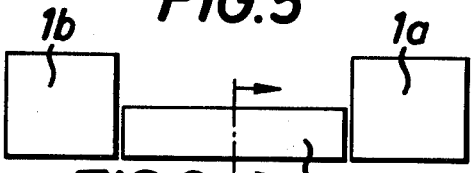
Figure 7:
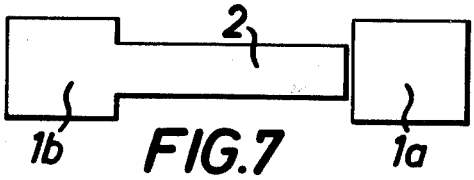
Figure 10:
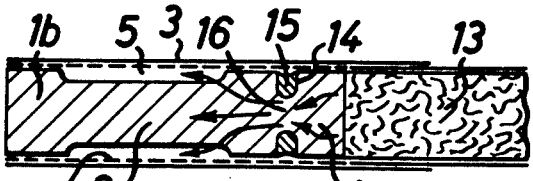
Figure 8:
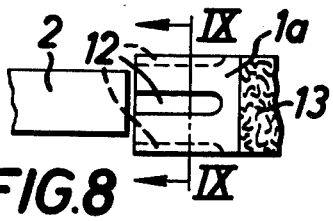
Figure 9:
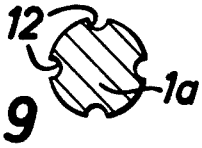

FIGS. 5 to 7 illustrate diagrammatically alternative ways of forming a filter body similar to that shown in FIGS. 1 to 3, FIGS. *6a* and *6b* are cross sections of alternative forms of an intermediate filter-body section shown in FIG. 6, FIGS. 8 and 9 are, respectively, a side elevation and cross section at IX—IX in FIG. 8, illustrating a modification, and FIG. 10 is an axial section illustrating another modification.

The filter shown in FIGS. 1–3 comprises a filter body in the form of a 20 mm long cylindrical plug 1 of celluloseacetate filter material consisting of end sections *1a*, *1b* with a diameter of 8 mm and, integral therewith, an intermediate section 2 which is 10 mm long and has a diameter of 6 mm. The plug 1 is wrapped in a porous paper plug wrap 3. In order to give support to the part of the wrap 3 which extends over the section 2, there is provided a heavier paper wrap 4 which underlies the wrap 3. The wrap 4 has closely spaced perforations of large diameter, for example 1.5 mm. The wrap 4 could be dispensed with by, for example, utilising a heavier, self-supporting, porous wrap 3. The wrap 3, or two wraps 3 and 4, may be impervious to particulate-phase constituents of tobacco smoke.

The body 1 may initially form part of a rod of celluloseacetate the length of which is six times that of a single body and the diameter of which is 8 mm. The rod is subjected at longitudinally spaced zones to a hot forming process (such as that described and claimed in the Specification of co-pending U.S. patent application Ser. No. 776,522, now U.S. Pat. No. 4,149,546) the rod thereby being reduced in these zones to the 6 mm diameter. This process may be applied so as to result in a partial sealing of the respective periphery surfaces of the reduced diameter sections 2 and to produce, in the vicinity of these surfaces, a slight compaction of the cellulose-acetate fibres. The rod is then wrapped in the support wrap 4 and the porous wrap 3 and the wrapped rod is cut transversely to provide six filters.

In the use of the filter on a cigarette, tobacco smoke passing through the intermediate region of the filter flows preferentially, at least partially, through the annular space 5 providing a smoke-flow path between the wrap 3 and the peripheral surface of the section 2, since the alternative path wholly within the cellulose acetate has a comparatively higher flow resistance. As the smoke passes along the space 5, high proportions of more volatile constituents of the smoke, especially carbon monoxide and nitric oxide, pass through the support wrap 4 and wrap 3 and are thus removed from the smoke. Also the pressure drop which is produced across the wrap 3 when smoke is drawn through the filter causes air to pass therethrough into the space 5.

The wrap 3 may be made either of paper which is inherently porous or of a paper which has been perforated in known manner, for example electrostatically, by mechanical pricking or by the use of a laser. The following table shows reductions in CO, NO and delivery of total particulate matter achieved by the above-described filter with wrap papers of several different porosities, but without a support wrap 4.

| Porosity of Wrapping Paper (W.T. Units)* | % Reduction in Delivery | | |
|---|---|---|---|
| | Carbon Monoxide | Nitric Oxide | Total Particulate Matter |
| Naturally Porous 1000 | 31 | 58 | 45 |
| Naturally Porous 5000 | 56 | 75 | 53 |
| Electrostatically Perforated 1000 | 31 | 61 | 51 |
| Electrostatically Perforated 3000 | 64 | 67 | 75 |
| Electrostatically Perforated 10,000 | 87 | 92 | 87 |

*W.T. Units are defined by the air flow in $cm^3$ per minute through 10 $cm^2$ of the paper under a pressure of 10 cm Water Gauge, namely $cm^3\ min^{-1}\ 10\ cm^{-2}\ (10\ cm\ W.G.)^{-1}$.

Filters closely similar to the filter of FIGS. 1–3 may also be manufactured on a filter-plug combining machine by assembling filter rods from cylindrical sections of cellulose acetate. These sections are derived from a first rod stock of 8 mm diameter and a second rod stock of 6 mm diameter. Sections cut from the 8 mm and the 6 mm diameter rod stock are arranged end-to-end, larger and smaller diameter sections alternating, and are wrapped in the porous paper plug wrap 3 of combination of wraps 3 and 4. The resulting filter rod is cut transversely at the middle of each of the larger diameter portions.

Figure 4:
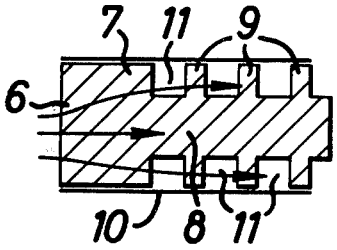
FIG. 4 shows another form of filter in axial section.

The cigarette filter shown in FIG. 4 comprises a body in the form of a generally cylindrical plug 6 of cellulose acetate. The body 6 comprises a first, full-diameter, section 7 and a second portion 8 which is of reduced diameter, but is provided with a number (three as shown) of circumferential ridge sections 9 each of a diameter equal to that of the section 7. The plug 6 is wrapped in a porous paper wrap 10 which is supported over the reduced portion 8 by the ridge sections 9.

The portion 8 of the body extends to the right of the right-hand end section 9. Thus, when the filter is incorporated in a cigarette with the full-diameter section 7 abutting the tobacco rod of the cigarette, the end surface of the filter further from the tobacco has a "stepped" appearance. The body 6 could, however, have at the right-hand end a further full-diameter section, similar to the section 7.

In use, tobacco smoke passing through the filter flows, at least preferentially, through a smoke-flow path comprising spaces 11 bounded by the wrap 10 and the peripheral surface of the portion 8 of the plug 6. Although the smoke must, in passing sequentially through the spaces 11, also flow through the cellulose acetate of the intervening ridges 9, this interrupted flow path still has a lower flow resistance than the alternative path, of equal length, wholly within the cellulose acetate of the body portion 8. High proportions of carbon monoxide, nitric oxide and other volatile constituents are removed from the smoke by diffusion through those portions of the wrap 10 bounding the spaces 11. Air is again drawn in, into the spaces 11, through these portions of the wrap 10.

The body 6 may be formed by the process described in the above-mentioned Application. The peripheral surface of the reduced portion 8 may thereby be partially sealed.

In the use of each of the filters illustrated, it is throught that a small proportion of the more volatile constituents of the smoke passing through the reduced section of the body diffuses through the partially sealed peripheral surface of that section and can thus also become subject to the diffusion removal of such constituents through the wrap 3 or 10.

The filters may be attached to tobacco rods by means of tipping papers, in which case the tipping paper, as well as the wrap 3 or 10, should be porous, so that carbon monoxide and nitric oxide can diffuse through both. Alternatively attachment may be effected by a narrow tipping band in which case the material of the band need not be porous.

The overall length of the filter body 1 or 6 may be as short as 10 mm or as long as 45 mm. The length of the reduced diameter portion may be selected from a range of 5 mm to 35 mm and the reduction in diameter from a range of 1.0 mm to 7.0 mm.

Figure 6A:
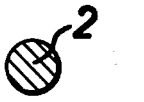
Figure 6B:
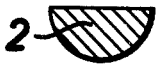

The construction and arrangement of such filters may be varied:

In the case of the example illustrated by FIGS. 1 to 3, the intermediate section 1 is integral with the end sections 1*a* and 1*b*. With the above-described alternative method of producing a similar filter, the end sections 1*a* and 1*b* are separate from the section 2, as illustrated diagrammatically in FIG. 5. The section 2 may be located eccentrically in relation to the sections 1*a* and 1*b*, as shown in FIG. 6, and its cross section may be circular or semicircular as shown in FIGS. 6*a* and 6*b* respectively. In the latter cases in particular, the sections 1*a* and 1*b* may be made integral with the section 2. Finally either of the sections 1*a* and 1*b* may be integral with the section 2, as illustrated for the section 1*b* in FIG. 7.

The section of the body upstream of the reduced section or portion may be shaped to promote preferential flow of the smoke to the space or spaces from which the outward diffusion of volatile constituents takes place. For example, as shown in FIGS. 8 and 9, the section 1*a* may be provided with circumferentially spaced longitudinal grooves 12 as illustrated in FIGS. 8 and 9. Instead of terminating short of the adjacent end of the tobacco rod 13 as shown, similar grooves could extend for the full length of the section 1*a*.

Instead of or in addition to such grooves, a cavity or cavities tapering towards the end of the section 1*a* remote from the tobacco may be provided in the surface of that section. The surface or surfaces of a such a cavity or groove may be sealed to render it or them substantially smoke impervious.

The space 5 or spaces 11 bounded by the intermediate section of the body may contain a substance, for example activated carbon, which contributes to the removal of vapour-phase smoke constituents.

Filters such as have been described above may incorporate or be combined either integrally or separately with a filter section which has a smoke-accelerating constriction of its cross section in the manner set forth and claimed in co-pending U.S. patent application Ser. No. 839,297. For example, a slightly longer section 1*a* may be provided, as shown in FIG. 10, with an annular groove 14 which is filled with a sealant 15, or has its walls sealed, so as to form a smoke-accelerating orifice 16 upstream of the remaining portion of that section and the sections 2 and 1*b*.

In the filter of FIG. 4 instead of utilising the circumferential ridges 9 of the plug 6 to support the plug wrap 10, the reduced portion 8 of the body may be provided for this purpose with lengthwise-extending ridges, so that there are a plurality of parallel smoke-flow spaces or passages.

The reduced portion 2 or 8 in any of the above-described examples may have other cross sections, triangular or polygonal sections for example.

We claim:

1. A tobacco-smoke filter having an axial flow filter body comprising at least one intermediate section which is located between end sections, has a cross section less than that of the end sections and lies wholly within the outline of the latter sections as viewed axially of the body, and a porous wrap of sheet material which has a porosity of at least 3,000 W.T. units and is pervious to volatile constituents of tobacco smoke and which forms, with said body, a smoke passage bounded by said porous sheet material around substantially the whole periphery of the body, from which passage said constituents can be removed from the smoke by diffusion through the said sheet material, each of the said sections being made of filter material.

2. A filter according to claim 1, wherein the body is of generally cylindrical form.

3. A filter according to claim 1, wherein the body is composed of cellulose acetate.

4. A filter according to claim 1, wherein the body has one intermediate section forming a single elongate annular space.

5. A filter according to claim 1, wherein the intermediate section is integral with at least one end section.

6. A filter according to claim 1, wherein the end section which, in use of the filter on a smoking article, is adjacent to the tobacco rod of the article is provided with formations for preferentially guiding smoke into the space or spaces.

7. A filter according to claim 1, wherein a said end section is formed with a smoke-accelerating constriction.

* * * * *